US009170535B2

(12) United States Patent
Kanou et al.

(10) Patent No.: US 9,170,535 B2
(45) Date of Patent: Oct. 27, 2015

(54) FIXING DEVICE AND IMAGE FORMING APPARATUS

(75) Inventors: Hirotaka Kanou, Toyokawa (JP); Tetsuya Kagawa, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 585 days.

(21) Appl. No.: 13/181,948

(22) Filed: Jul. 13, 2011

(65) Prior Publication Data

US 2012/0014727 A1 Jan. 19, 2012

(30) Foreign Application Priority Data

Jul. 16, 2010 (JP) ..... 2010-161472

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01)

(58) Field of Classification Search
CPC ..... G03G 15/2053; G03G 15/2003
USPC ..... 399/334
See application file for complete search history.

(56) References Cited

U.S. PATENT DOCUMENTS

2005/0067408 A1 3/2005 Fujii et al.
2005/0199613 A1* 9/2005 Samei et al. ..... 219/619
2008/0149621 A1* 6/2008 Kanou et al. ..... 219/619
2008/0260436 A1 10/2008 Takagi et al.
2009/0297197 A1* 12/2009 Hase ..... 399/69

FOREIGN PATENT DOCUMENTS

JP 2001-60490 A 3/2001
JP 2005-108603 A 4/2005
JP 2008-139475 A 6/2008
JP 2008-270215 A 11/2008
JP 2009-271154 A 11/2009

OTHER PUBLICATIONS

Office Action (Notification of Reasons for Refusal) dated May 1, 2012, issued in corresponding Japanese Patent Application No. 2010-161472, and an English Translation thereof (with Verification of Translation). (7 pages).

* cited by examiner

*Primary Examiner* — David Gray
*Assistant Examiner* — Andrew V Do
(74) *Attorney, Agent, or Firm* — Buchanan Ingersoll & Rooney PC

(57) ABSTRACT

In a fixing device thermally fixing toner images on recording sheets of various sizes, (i) a conductive heat generating rotational body configured to heat toner images, (ii) an excitation coil positioned along a part of an outer circumferential surface of the heat generating rotational body and configured to generate a magnetic flux to heat the heat generating rotational body by electromagnetic induction, and (iii) a demagnetization coil positioned close to the excitation coil so as to cover a part of the excitation coil and configured to cancel, when a toner image is being fixed on a smaller-sized recording sheet, a part of the magnetic flux generated by the excitation coil so that overheating is prevented in a non sheet-passing region, are provided. The demagnetization coil has a thickness smaller than a thickness of the excitation coil in an axis direction of the coils.

9 Claims, 10 Drawing Sheets

115

115

FIXING DEVICE AND IMAGE FORMING APPARATUS

This application is based on an application No. 2010-161472 filed in Japan, the contents of which are hereby incorporated by reference.

BACKGROUND OF THE INVENTION (1) Field of the Invention

The present invention relates to an electromagnetic induction-heating type fixing device and an image forming apparatus including such a fixing device, and in particular to a technology for improving a speed for fixing toner images on recording sheets of a small size (hereinafter, referred to as "small-sized recording sheets") in a fixing device that fixes toner images on recording sheets of various sizes.

(2) Related Art

In recent years, in the field of an image forming apparatus, saving of energy has been increasingly required as a part of global warming countermeasures, and accordingly, an induction-heating type fixing device that realizes high energy efficiency has been attracting attention.

An induction-heating type fixing device passes recording sheets through a fixing nip portion that is formed by a heating roller heated by induction heating and a pressurizing roller pressed against the heating roller so as to fuse and fix toner images thereon, for example.

In the fixing device that fixes toner images on recording sheets of various sizes, not only an excitation coil but also a demagnetization coil is used. The excitation coil heats the heating roller by induction heating over a width of the maximum sheet-passing region of the fixing device. The demagnetization coil prevents overheating of a part of a fixing roller in a region where, while small-sized recording sheets are passing through in the sheet-passing region, these sheets do not pass through (hereinafter, referred to as "non sheet-passing region").

FIG. 9 is an appearance perspective view showing an excitation coil and demagnetization coils pertaining to a conventional art. As FIG. 9 shows, demagnetization coils 901 are provided at positions corresponding to non sheet-passing regions that are aligned with both ends of fed small-sized recording sheets in a width direction thereof.

When small-sized recording sheets are passed through, a circuit of the fixing device for applying current is closed and accordingly current inducted by a magnetic flux generated by an excitation coil 902 flows through the demagnetization coils 901. This causes the demagnetization coils 901 to generate a reversed polarity magnetic flux, which cancels the magnetic flux generated by the excitation coil 902. On the other hand, when recording sheets of a large size are passed through, the circuit is opened and accordingly demagnetization is stopped.

An image forming apparatus has been always required to improve a printing speed. It is thus necessary to increase a process speed (hereinafter, referred to as "fixing speed") of a fixing device, that is, the number of recording sheets on which fixing is performed in units of time. In order to improve the fixing speed, more heat is naturally required, and accordingly output of an excitation coil is required to be increased.

However, there is a problem that, if output of the excitation coil is increased, overheating of a heating roller in the non sheet-passing region becomes too extreme for practical use. FIG. 10 shows a temperature of the non sheet-passing region when recording sheets of an A6T size (105 [mm]×148.5 [mm]) are passed through in an image forming apparatus that can fix recording sheets of up to an A3 size. A horizontal axis of FIG. 10 represents a position (distance from the center of a sheet-passing region) in a direction perpendicular to a direction in which the recording sheets pass through, and a longitudinal axis of FIG. 10 represents a temperature of a fixing roller. Besides, a solid line 2101 and a dashed line 2102 indicate temperature distributions in the cases where speeds of passing through the recording sheets are 75 [ppm] and 65 [ppm], respectively. Note that ppm (papers per minute) represents the number of recording sheets that are passed for one minute.

As FIG. 10 shows, in the sheet-passing region, the fixing roller is deprived of heat by the recording sheets and heated by an excitation coil by electromagnetic induction at the same time, and accordingly a fixing temperature of the sheet-passing region remains at an appropriate temperature. On the other hand, since the recording sheets do not perform cooling of the fixing roller in the non sheet-passing region, a temperature of the fixing roller in the non sheet-passing region becomes higher than in the sheet-passing region.

Also, as the dashed line 2102 shows, when the speed of passing through the recording sheets is 65 [ppm], the highest temperature does not exceed 240° C., which is a general heat resistant temperature of silicone rubber. However, as the solid line graph 2101 shows, when the speed is increased to 75 [ppm], it turns out that the temperature exceeds 240° C. in some positions.

SUMMARY OF THE INVENTION

The present invention has been achieved in view of the above problems, and aims to provide a fixing device and an image forming apparatus that realize improvement of the fixing speed and prevention of overheating in the non sheet-passing region at the same time.

In order to achieve the above aim, a fixing device thermally fixes toner images on recording sheets of various sizes, the fixing device comprising: a conductive heat generating rotational body configured to heat toner images; an excitation coil positioned along a part of an outer circumferential surface of the heat generating rotational body and configured to generate a magnetic flux to heat the heat generating rotational body by electromagnetic induction; and a demagnetization coil positioned close to the excitation coil so as to cover a part of the excitation coil and configured to cancel, when a toner image is being fixed on a smaller-sized recording sheet, a part of the magnetic flux generated by the excitation coil so that overheating is prevented in a region where no recording sheet passes through of the heat generating rotational body, wherein the demagnetization coil has a thickness smaller than a thickness of the excitation coil in an axis direction of the coils.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following explains an embodiment of the fixing device and the image forming apparatus pertaining to the present invention with reference to the drawings.

[1] Structure of the Image Forming Apparatus

First, a structure of the image forming apparatus pertaining to a present embodiment will be explained.

Figure 1:
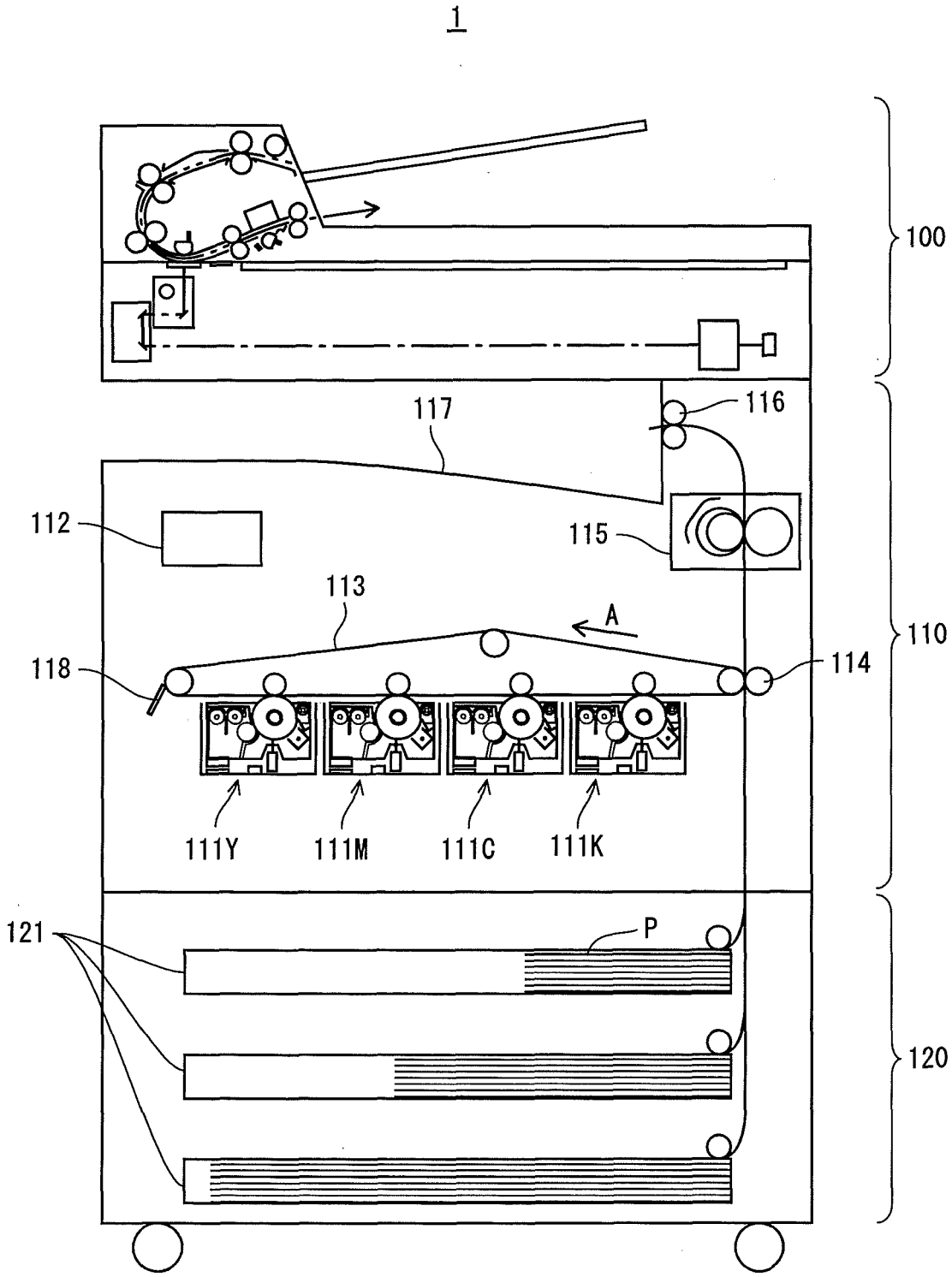
FIG. 1 shows a main structure of the image forming apparatus pertaining to an embodiment of the present invention.

FIG. 1 shows a main structure of the image forming apparatus pertaining to the present embodiment. As FIG. 1 shows, an image forming apparatus 1 includes a document reader 100, an image forming section 110 and a paper feeder 120. The document reader 100 generates image data by optically reading documents.

The image forming section 110 includes image forming units 111Y-111K, a controller 112, an intermediate transfer belt 113, a pair of secondary transfer rollers 114, a fixing device 115, a sheet ejecting roller 116, an ejected-sheet tray 117 and a cleaner 118.

The image forming units 111Y-111K form toner images in yellow (Y), magenta (M), cyan (C), and black (K) respectively under the control of the controller 112. The toner images are electrostatically transferred (primarily transferred) onto the intermediate transfer belt 113 so as to be superimposed. The intermediate transfer belt 113 is an endless rotational body that is rotated in a direction of an arrow A, and conveys the toner images to a secondary transfer position.

The paper feeder 120 includes feeding cassettes 121 that each store therein recording sheets P according to size and feed the recording sheets P to the image forming section 110. The fed recording sheets P are conveyed to the secondary transfer position in parallel with conveyance of the toner images by the intermediate transfer belt 113.

The pair of secondary transfer rollers 114 are a pair of rollers that have a potential difference, and the pair of rollers are pressed against each other to form a transfer nip portion therebetween. At the transfer nip portion, the toner images on the intermediate transfer belt 113 are electrostatically transferred (secondarily transferred) onto the recording sheets P. The recording sheets P onto which the toner images are transferred are conveyed to the fixing device 115.

The fixing device 115 is an electromagnetic induction-heating type fixing apparatus that heats and fuses the toner images so that the toner images are fixed onto the recording sheets P. The recording sheets P on which the toner images have been fused are ejected on the ejected-sheet tray 117 by the sheet ejecting roller 116.

[2] Structure of the Fixing Device 115

Next, a structure of the fixing device 115 will be explained.

Figure 2:
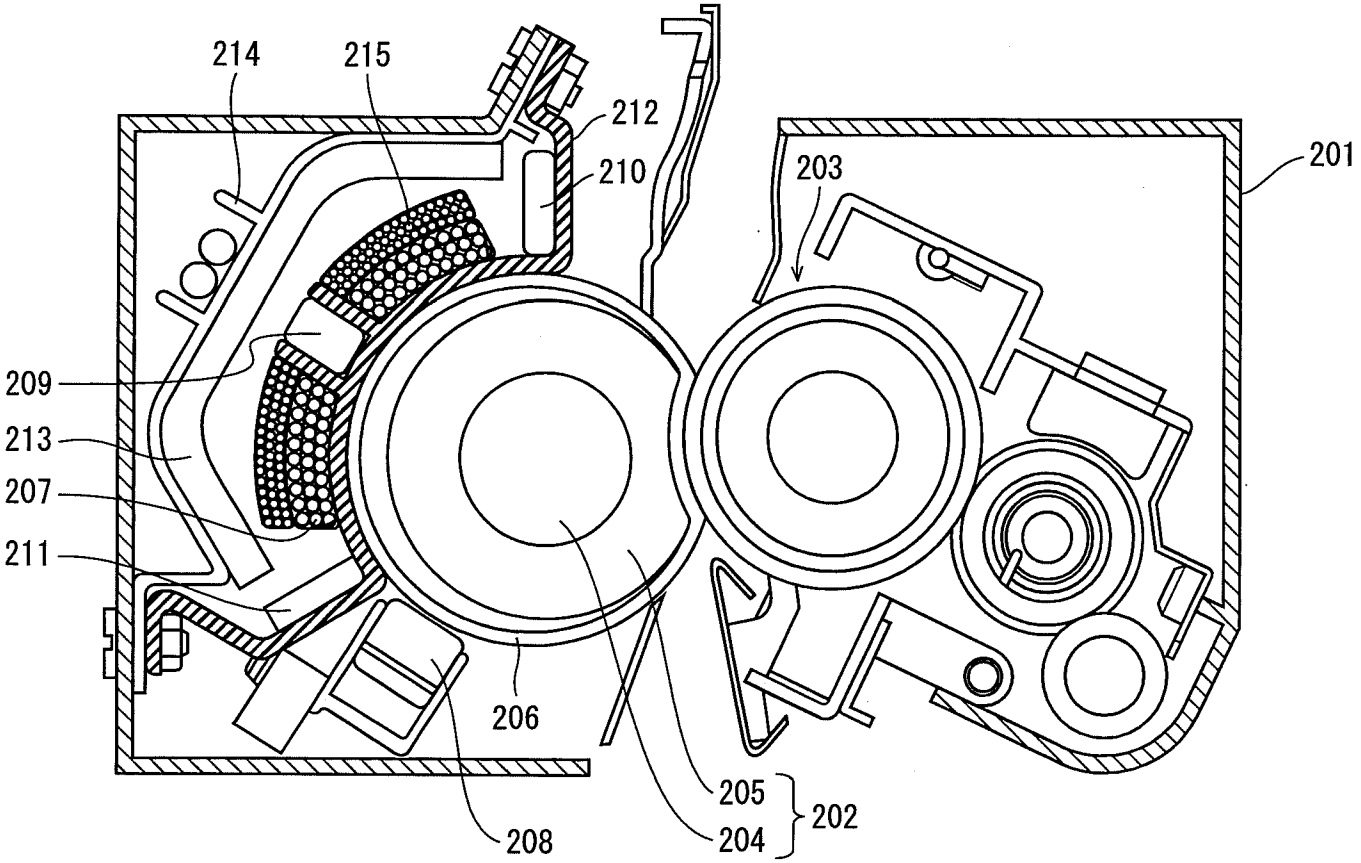
FIG. 2 is a cross-sectional view showing a main structure of a fixing device 115 pertaining to the embodiment of the present invention.

FIG. 2 is a cross-sectional view showing a main structure of the fixing device 115. As FIG. 2 shows, in the fixing device 115, a fixing roller 202 and a pressurizing roller 203 are arranged in parallel inside a housing 201 so as to be pressed against each other, and the pressurizing roller 203 is rotated by a driving motor (not illustrated). The fixing roller 202 is sometimes referred to herein as a heat generating rotational body. The fixing roller 202 includes a metal core 204, and an insulating elastic layer 205 that is made of materials such as silicone sponge and formed around a circumferential surface of the metal core 204.

Figure 3:
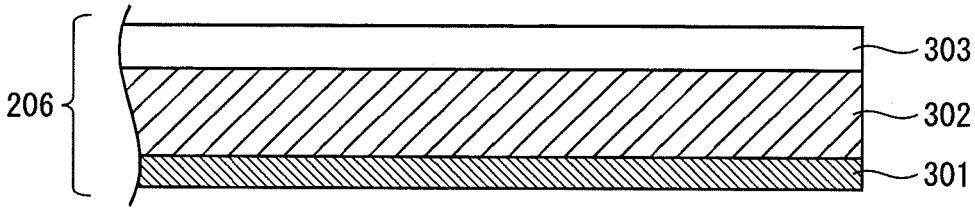
FIG. 3 is a cross-sectional view showing a structure of a fixing belt 206 pertaining to the embodiment of the present invention.

An endless fixing belt 206 is freely fit around a circumferential surface of the fixing roller 202. As FIG. 3 shows, the fixing belt 206 is formed by layering three layers including a metal heat generating layer 301, an elastic layer 302 and a release layer 303 in this order with the metal heat generating layer 301 being nearest to the circumferential surface of the fixing roller 202. The metal heat generating layer 301 is formed of a Ni electroformed sleeve, and generates heat by electromagnetic induction by an alternating magnetic flux generated by an excitation coil 207.

The pressurizing roller 203 is pressed against the fixing belt 206 by a pressing mechanism (not illustrated). This changes mainly a shape of the insulating elastic layer 205 of the fixing roller 202 and a nip width necessary for fixing is obtained. In correspondence with rotation of the pressurizing roller 203, the fixing belt 206 and the fixing roller 202 are rotated.

In the vicinity of the circumferential surface of the fixing belt 206, an infrared sensor 208 is disposed. The infrared sensor 208 that is out of contact with the fixing belt 206 detects a signal indicating a surface temperature of substantially a central part of the circumferential surface of the fixing belt 206 in a rotational axis direction of the fixing belt 206, and then transmits the detected signal. The controller 112 receives the detected signal and controls power supply to the excitation coil 207 so that the temperature of the fixing belt 206 is controlled to be a predetermined value.

The excitation coil 207, a center core 209 and hem cores 210 and 211 are held by a coil bobbin 212, and main cores 213 are held by a core holding member 214. The excitation coil 207 can generate a magnetic flux with necessary density for heat generation over a width of a part of the fixing belt 206, which corresponds to a width of the maximum sheet-passing region.

The center core 209, the hem cores 210 and 211, and the main core 213 are made of a magnetic material with high permeability and low loss characteristics, such as a ferrite alloy and a permalloy alloy, and form a magnetic circuit with the fixing belt 206 and the excitation coil 207. Thus, it is possible to prevent leaks of a magnetic flux to outside of the magnetic circuit, and accordingly heat generation efficiency improves.

The excitation coil 207 is held by the coil bobbin 212. The excitation coil 207 is connected to a high-frequency inverter (not illustrated), and high-frequency power of 10-100 [kHz] and 100-2000 [W] is supplied to the excitation coil 207. Accordingly, the excitation coil 207 is preferably made by winding litz wire consisting of thin wires that are covered with heat resistant resin and bundled together. The present embodiment employs the excitation coil 207 that is made by winding the litz wire 10 turns. The litz wire consists of 114 wires bundled and twisted together and a diameter of each of the wires is ø0.17.

In addition, demagnetization coils 215 are provided on both ends of the excitation coil 207 in the rotational axis direction of the fixing belt 206, which correspond to the non sheet-passing region through which small-sized recording sheets do not pass. The demagnetization coils 215 are attached firmly to an outer surface of the excitation coil 207 and an insulating sheet is sandwiched between the demagnetization coils 215 and the excitation coil 207. Note that, in the present embodiment, three pairs of demagnetization coils 215 (hereinafter, referred to as "demagnetization coils 215*a*-215*c*") are employed in order to support recording sheets of various sizes. Each of the demagnetization coils 215*a*-215*c* is made by winding litz wire 19 turns. The litz wire consists of 20 wires bundled and twisted together and a diameter of each of the wires is ø0.17.

Figure 4:
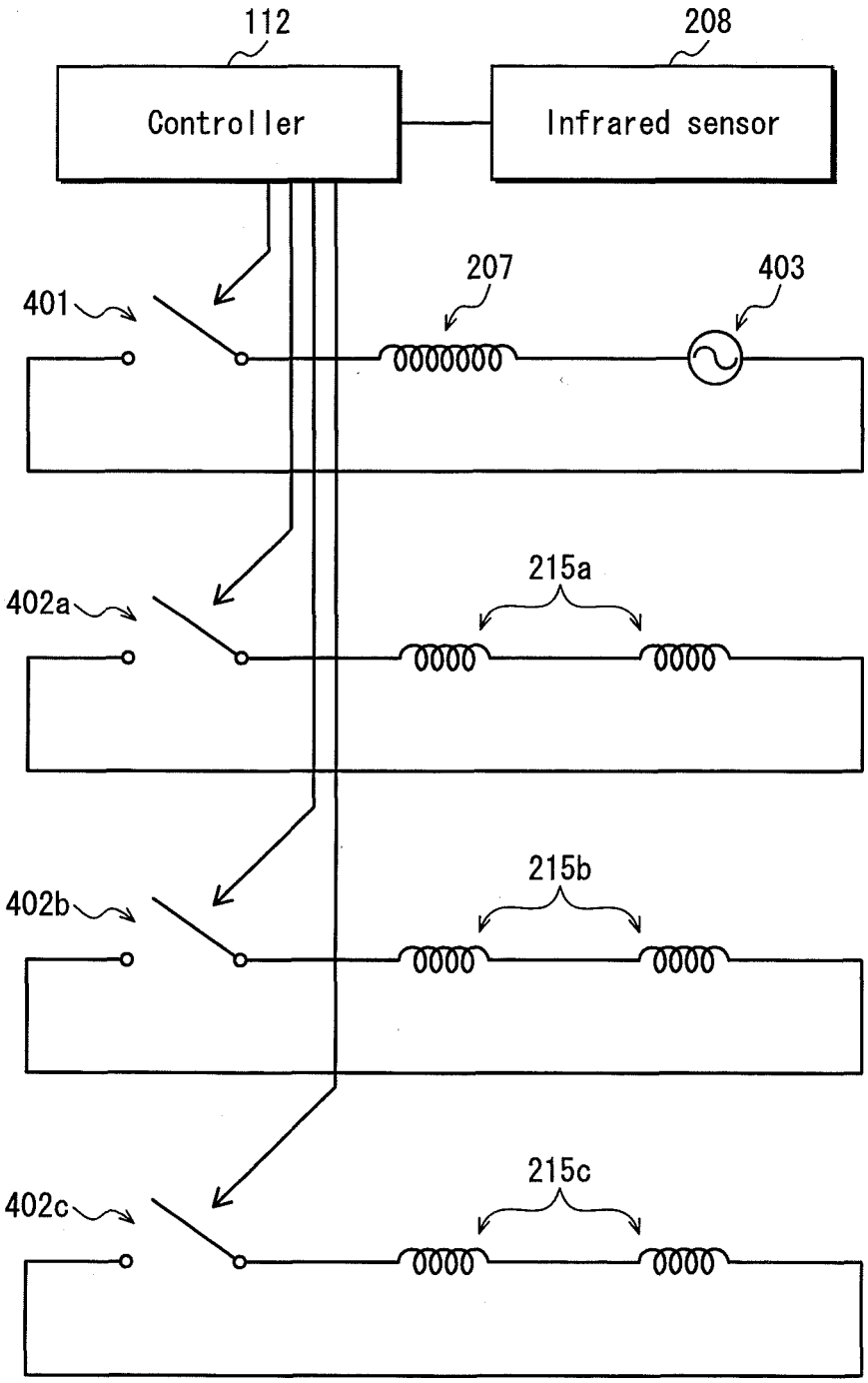
FIG. 4 shows a circuit structure for controlling an excitation coil 207 and demagnetization coils 215*a*-215*c* pertaining to the embodiment of the present invention.

FIG. 4 shows a circuit structure for controlling the excitation coil 207 and the demagnetization coils 215*a*-215*c*. As FIG. 4 shows, the excitation coil 207 is electrically connected to a high-frequency power source 403 through a switching relay 401. In addition, the demagnetization coils 215*a*-215*c* are electrically connected to switching relays 402*a*-402*c* in series, respectively, to form loop circuits. The switching relays 401 and 402*a*-402*c* are each under the control of the controller 112.

The controller 112 monitors a temperature of the non sheet-passing region with the infrared sensor 208. When the temperature reaches a predetermined value, the controller 112 switches one or more the switching relays 402*a*-402*c* ON depending on a size of fed recording sheets so as to cause a corresponding one or more of the demagnetization coils 215*a*-215*c* to generate an opposite magnetic flux. By doing this, it is possible to cancel a magnetic flux generated by the excitation coil 207, and accordingly overheating at the non sheet-passing region can be prevented. Note that, it is obvious that, during image formation, the controller 112 switches the switching relay 4010N to supply power to the excitation coil 207 to perform electromagnetic induction heating.

The main cores 213 are bent to be trapezoidal so as to cover the excitation coil 207. The main cores 213 that are some to dozen in number are held by the core holding member 214 at a predetermined interval therebetween in a direction parallel to an axis direction of the fixing roller 202. Two of the main cores 213 that are positioned at both ends in the axis direction have high magnetic coupling in order to help heat dissipation from both ends of the fixing belt.

In addition, each of the center core 209 and the hem cores 210 and 211 has an elongated shape and is parallel to the axis direction of the fixing roller 202, and is bonded to the coil bobbin 212 with use of a heat resistant adhesive agent such as a silicone adhesive agent. Each of the hem cores 210 and 211 may be divided into two in the axis direction, but must be arranged without space therebetween.

The center core 209 uniformly leads a magnetic flux generated by the excitation coil 207 to the fixing belt 206. A magnetic flux penetrating through the fixing belt 206 induces eddy current, and then the fixing belt 206 generates Joule heat.

The coil bobbin 212 and the core holding member 214 are fixed by bolts and nuts at hem portions thereof. Alternatively, other components such as rivets may be used to fix the coil bobbin 212 and the core holding member 214.

Figure 5:
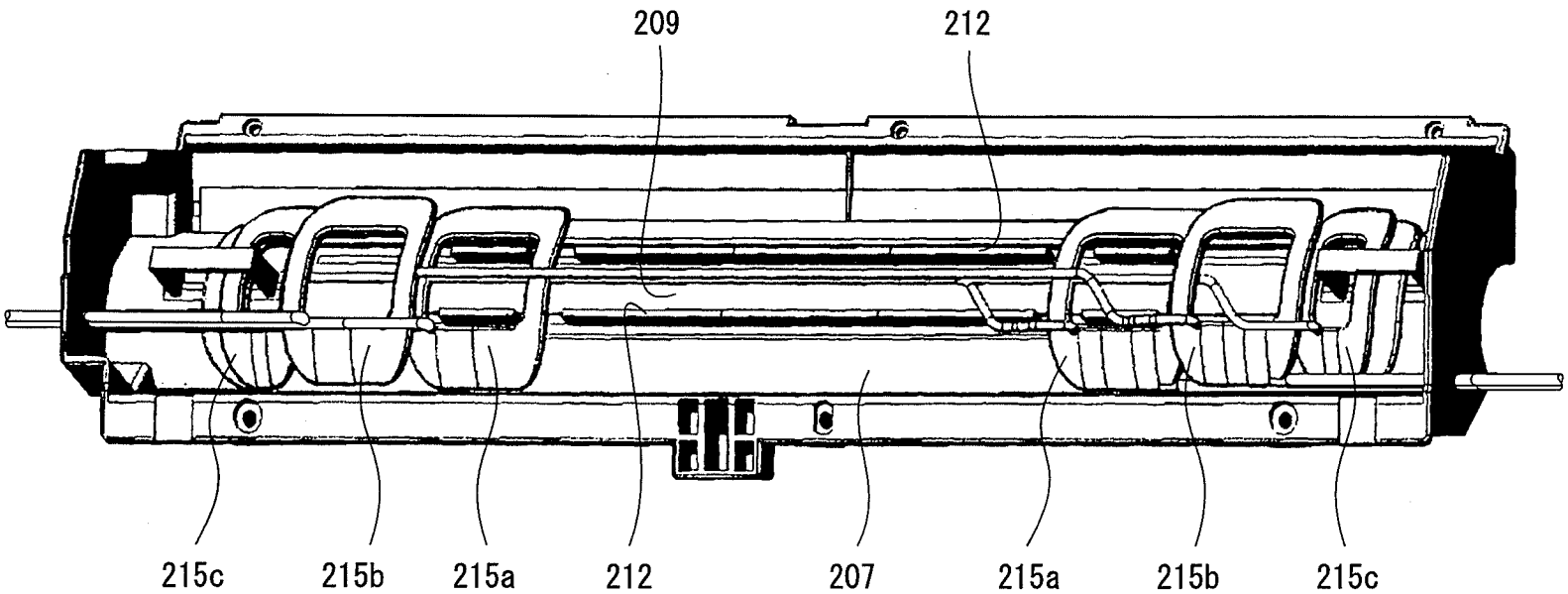
FIG. 5 is an appearance perspective view of the fixing device 115 pertaining to the embodiment of the present invention.

FIG. 5 is an appearance perspective view of the fixing device 115. Note that the main cores 213 have been removed for easier viewing of the demagnetization coils 215*a*-215*c*. As FIG. 5 shows, the fixing device 115 pertaining to the present embodiment includes the three pairs of demagnetization coils 215*a*-215*c*. The demagnetization coils 215*a*-215*c* are selectively switched ON/OFF depending on a size of fed recording sheets.

To be specific, when recording sheets of the smallest size are fed, all of the demagnetization coils 215*a*-215*c* are switched ON. As a size of fed recording sheets becomes larger, the demagnetization coil 215*a* is firstly switched OFF, and as the size further becomes larger, the demagnetization coils 215*b* and 215*c* are switched OFF in this order. When recording sheets of the largest size are fed, all of the demagnetization coils 215*a*-215*c* are switched OFF.

In addition, each of the demagnetization coils 215*a*-215*c* has parallel portions that are parallel to the rotational axis of the fixing belt 206, and bent portions that connect the parallel portions with each other. Each of the parallel portions has a larger width, and each bent portion has a small width. Accordingly, the parallel portions are thin and the bent portions are thick in the axis direction of the coils, i.e., the radial direction of the heat generating rotational body.

[3] Demagnetization Efficiency

Next, the following explains advantage in demagnetization efficiency that the demagnetization coils 215*a*-215*c* pertaining to the present embodiment have, compared with demagnetization coils pertaining to the conventional art.

(1) Shape of Demagnetization Coils and Demagnetization Efficiency

First, a relationship between forms of the demagnetization coils and demagnetization efficiency will be explained.

Figure 6:
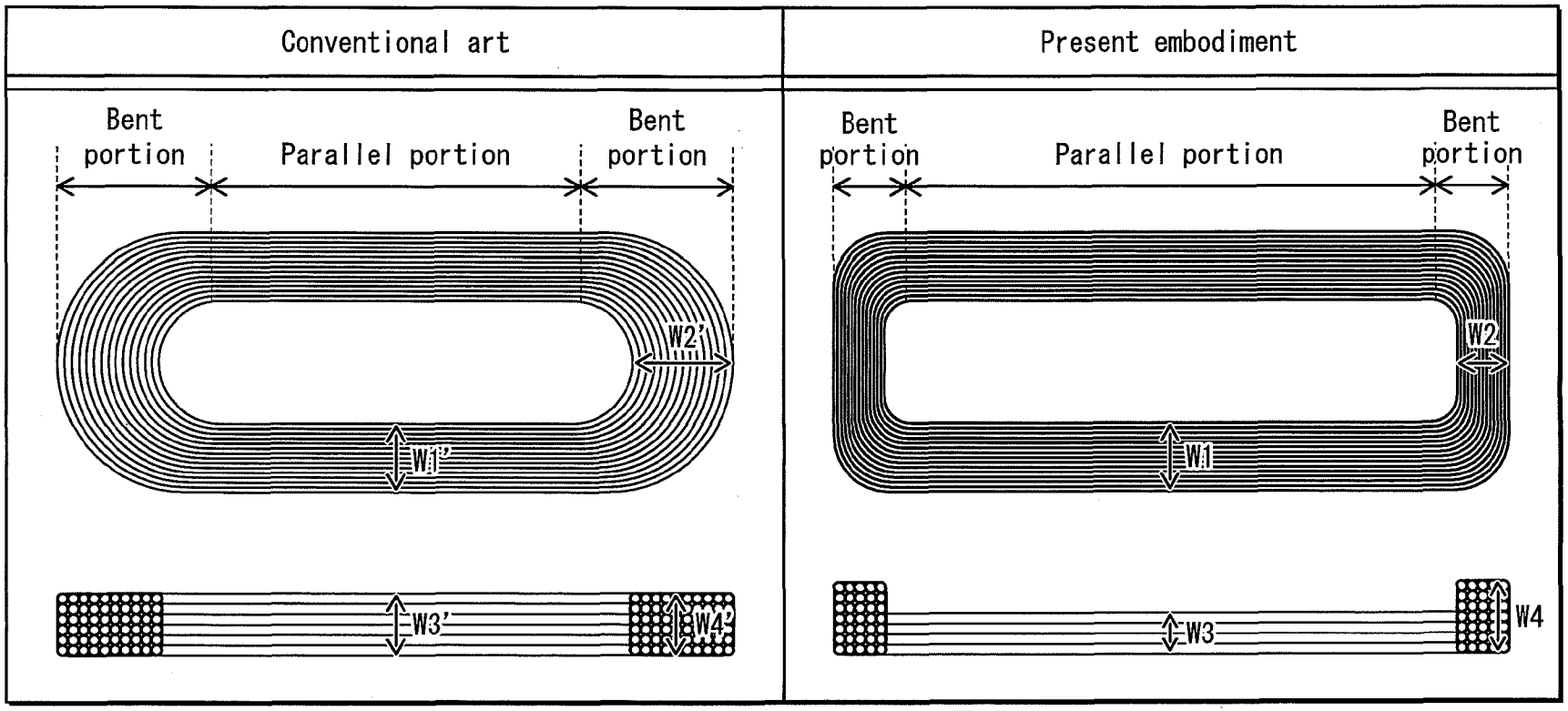
FIG. 6 compares, in a plan view and in a lateral view, an appearance profile of one of the demagnetization coils 215*a*-215*c* pertaining to a present embodiment with an appearance profile of a demagnetization coil pertaining to the conventional art.

FIG. 6 compares, in a plan view and in a lateral view, an appearance profile of any one of the demagnetization coils 215*a*-215*c* pertaining to the present embodiment with an appearance profile of a demagnetization coil pertaining to the conventional art. Here, as an example, the demagnetization coil pertaining to the conventional art is made by winding litz wire 10 turns. The litz wire consists of 114 wires bundled and twisted together and a diameter of each of the wires is ø0.17. This is because, conventionally, a demagnetization coil and an excitation coil are made by litz wires each consisting of wires of the same number and the same diameter for material cost reduction. Therefore, the demagnetization coil pertaining to the conventional art matches the excitation coil 207 pertaining to the present embodiment.

As FIG. 6 shows, according to the conventional art, bent portions of the demagnetization coil are curved with a high curvature in the plan view, and a width w1' of parallel portions and a width w2' of the bent portions are substantially the same. Also, in the lateral view, a width w3' of the parallel portions is 2.8t, which is the same as a width w4' of the bent portions.

On the other hand, according to the present embodiment, curvature of the bent portions of each of the demagnetization coils 215*a*-215*c* is low in the plan view, and also, a width w2 of the bent portions is smaller than a width w1 of the parallel portions. Accordingly, each of the demagnetization coils 215*a*-215*c* has a substantially rectangular shape in the plan view.

On the other hand, in the lateral view, while a width w3 of the parallel portions is 1.0t, a width w4 of the bent portions is 1.9t. That is, the bent portions have a thickness larger than a thickness of the parallel portions. This is because the litz wire at the bent portions has been concentrated in order to narrow the width thereof.

Thus, each of the demagnetization coils 215*a*-215*c* pertaining to the present embodiment has a thickness smaller than a thickness of the demagnetization coil pertaining to the conventional art. Besides, as a distance to the excitation coil 207 becomes smaller, a density of a magnetic flux generated by the excitation coil 207 increases. Therefore, when the demagnetization coils are closely in contact with the excitation coil, the thinner the demagnetization coils become, the higher demagnetization efficiency can be. Accordingly, the demagnetization coils 215*a*-215*c* pertaining to the present embodiment can achieve higher demagnetization efficiency than the demagnetization coil pertaining to the conventional art.

Figure 7:
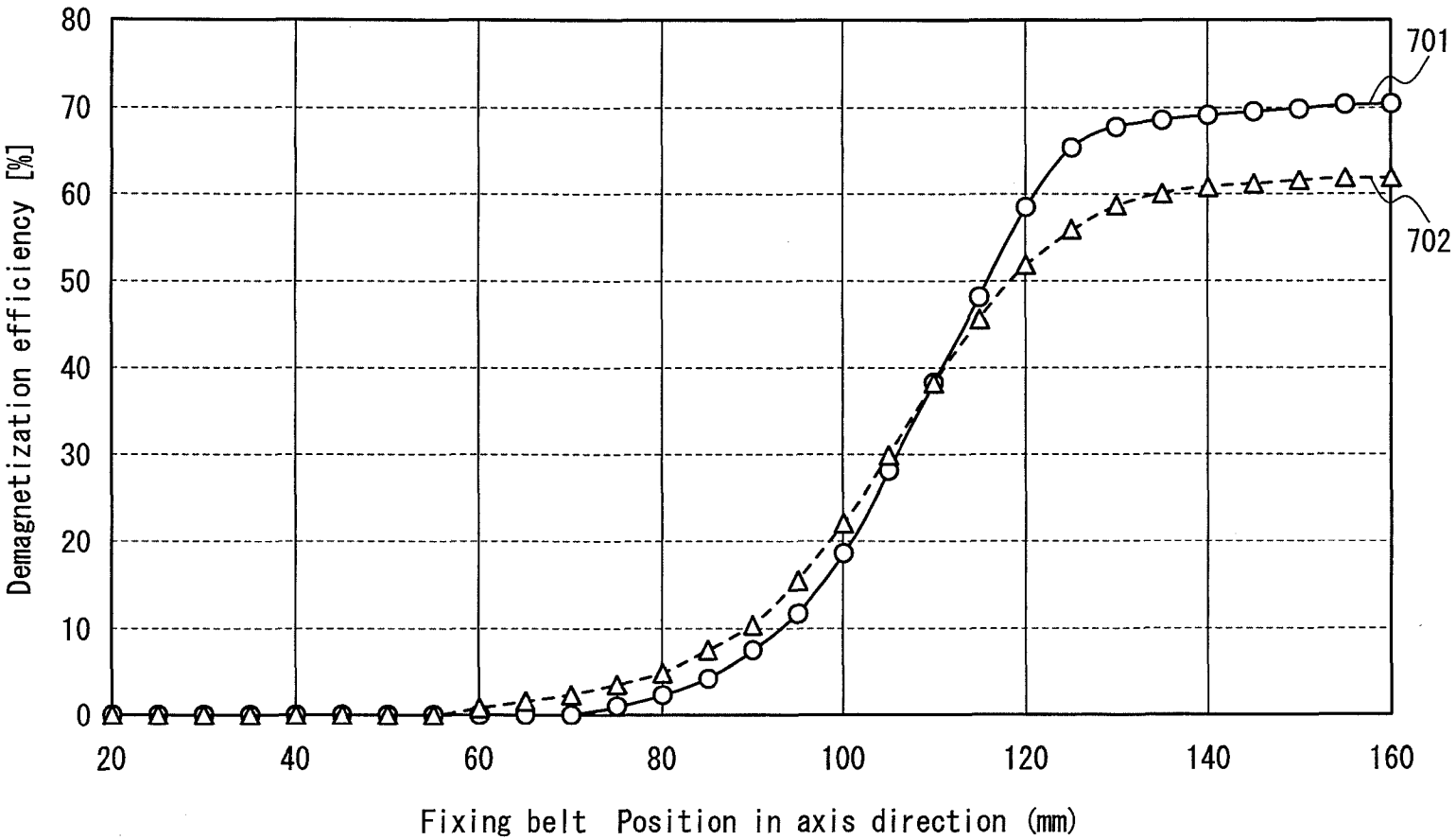
FIG. 7 shows a graph comparing demagnetization efficiency of the demagnetization coil pertaining to the conventional art with demagnetization efficiency of the demagnetization coil pertaining to the present embodiment in the vicinity of a boundary between a sheet-passing region and a non sheet-passing region.

Next, a difference of demagnetization efficiency will be compared in more detail. FIG. 7 shows a graph comparing demagnetization efficiency of the demagnetization coil pertaining to the conventional art with demagnetization efficiency of the demagnetization coil pertaining to the present embodiment in the vicinity of a boundary between the sheet-passing region and the non sheet-passing region. A solid line 701 represents the demagnetization efficiency of the demagnetization coils pertaining to the present embodiment, and a dashed line 702 represents the demagnetization efficiency of the demagnetization coil pertaining to the conventional art. Also, a longitudinal axis of FIG. 7 represents demagnetization efficiency and a horizontal axis of FIG. 7 represents a position in the rotational axis direction of the fixing belt.

As FIG. 7 shows, inclination of the solid line 701 is steeper than inclination of the dashed line 702 in the vicinity of the boundary. In addition, the solid line 701 indicates demagnetization efficiency higher than demagnetization efficiency indicated by the dashed line 702 in the non sheet-passing region, but in the sheet-passing region, the solid line 701 indicates the demagnetization efficiency lower than the demagnetization efficiency indicated by the dashed line 702.

Accordingly, the demagnetization coils 215*a*-215*c* pertaining to the present embodiment can prevent a negative effect caused by their adverse effect, i.e., reduction of a temperature within the sheet-passing region. This can be expected because the curvature of the bent portions of each of the demagnetization coils 215*a*-215*c* is low and each of the demagnetization coils 215*a*-215*c* has a substantially rectangular shape in the plan view.

Similarly, if curvature of bent portions of the excitation coil 207 is made low and a shape of the excitation coil 207 is made substantially rectangular in the plan view, heat generation outside the maximum sheet-passing region can be reduced.

(2) Thickness of Demagnetization Coils and Demagnetization Efficiency

Next, a relation between a thickness of each of the demagnetization coils and demagnetization efficiency will be explained.

In order to improve demagnetization efficiency of a demagnetization coil, it is necessary to improve magnetic coupling between an excitation coil and the demagnetization coil. To do this, for example, it can be thought that the excitation coil is made thin. However, if the number of wires bundled and twisted together to be litz wire constituting the excitation coil is reduced and the number of turns is increased, an electric resistance value of the excitation coil increases and accordingly heat generation efficiency is reduced. In addition, there is a limitation in making the excitation coil thin by compression with a press device.

Here, in the present invention, in order to make the demagnetization coils thin to increase magnetic coupling with the excitation coil, each of the demagnetization coils is made of the litz wire consisting of fewer wires bundled and twisted together. By doing this, not only the demagnetization coils can be thin but also manufacturing cost of the litz wires can be reduced. However, when the number of wires bundled and twisted together is reduced, an electric resistance value of each of the demagnetization coils increases and accordingly a temperature of each of the demagnetization coils per se extremely increases. Therefore, preferably, the number of wires bundled and twisted together to be the litz wire should be determined so that the temperature of each of the demagnetization coils is prevented from exceeding heat resistant temperatures of the litz wire and the coil bobbin 212. Since current flowing through the demagnetization coils is proportional to electric power necessary for heating the fixing belt 206, the number of wires bundled and twisted together should be selected from the range between a few to several tens according to the fixing speed or a fixing temperature (fusing temperature of toner).

As described above, each of the demagnetization coils pertaining to the present embodiment has a thickness smaller than a thickness of the demagnetization coil pertaining to the conventional art in the axis direction thereof. Thus, by making the demagnetization coils thin, demagnetization efficiency can be improved.

Figure 8:
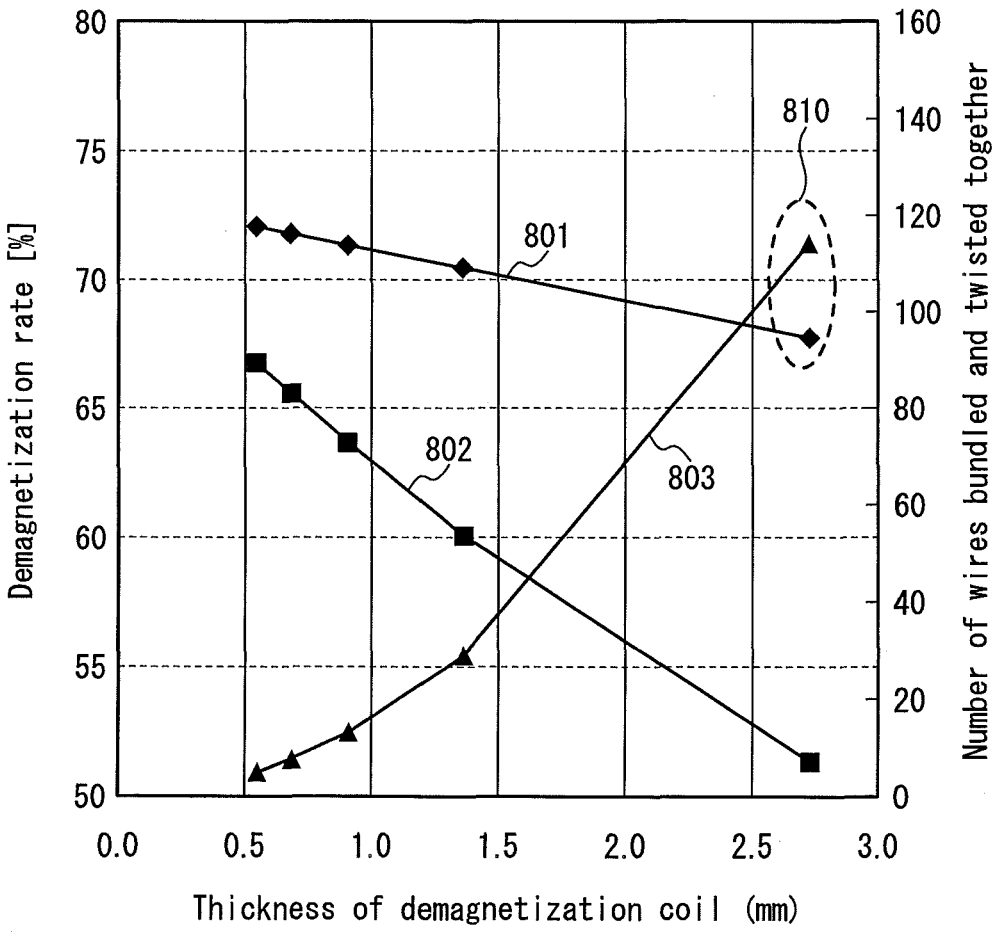
FIG. 8 shows a graph of a relationship among a thickness of a demagnetization coil, a demagnetization rate and the number of wires bundled and twisted together and constituting litz wire, using CAE analysis.
Figure 9:
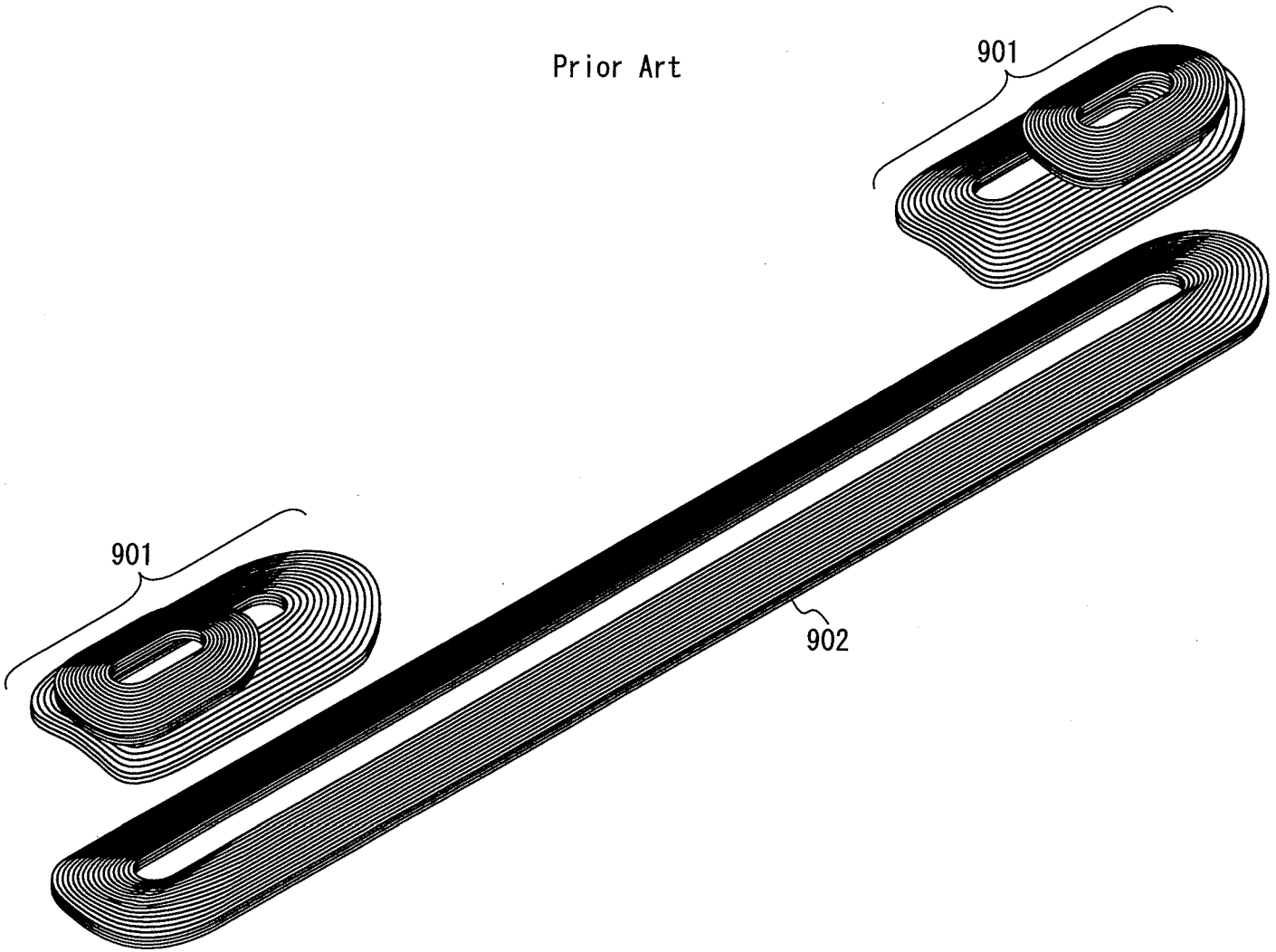
FIG. 9 Prior Art
FIG. 9 is an appearance perspective view showing an excitation coil and demagnetization coils pertaining to the conventional art.
Figure 10:
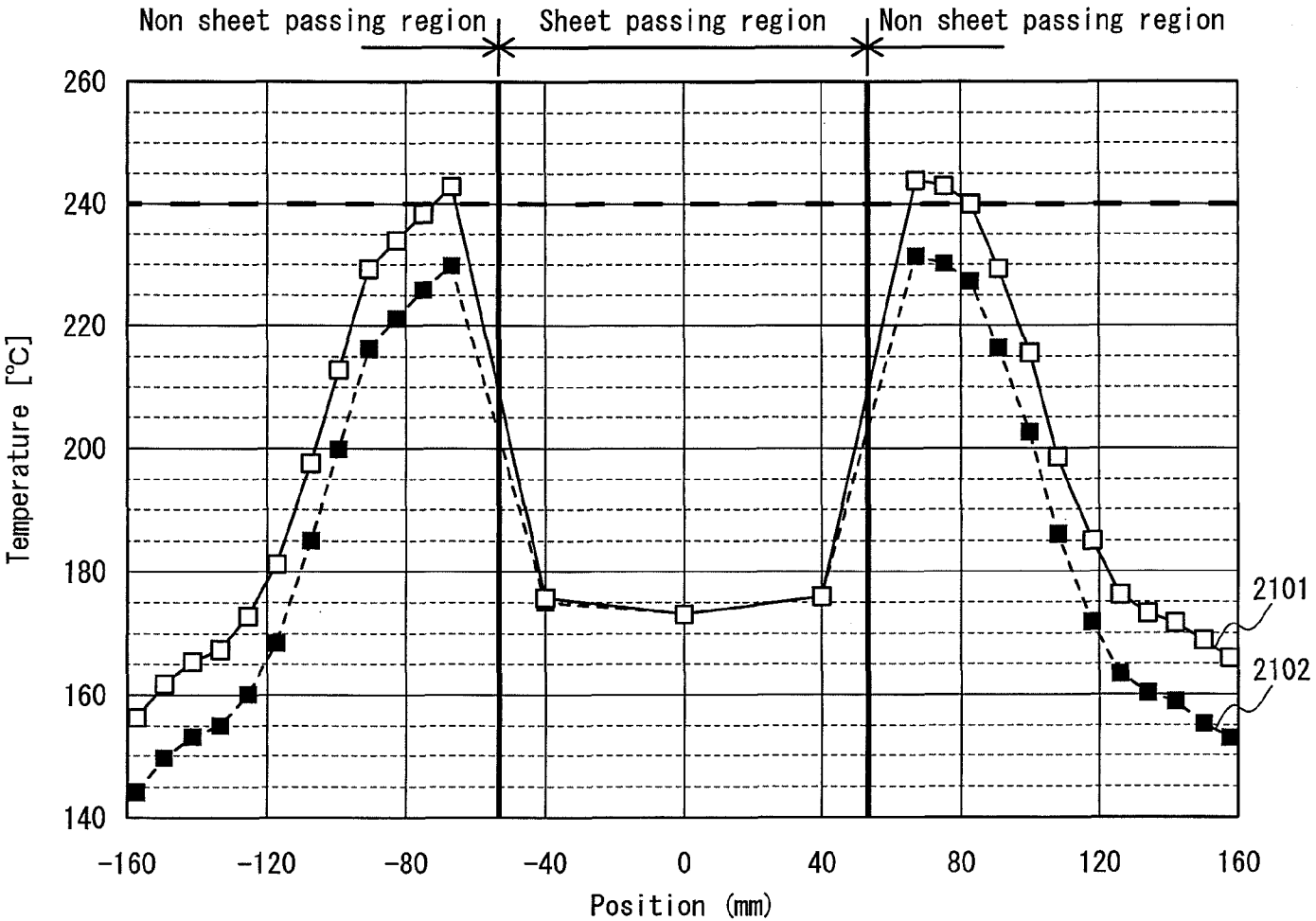
FIG. 10 Prior Art
FIG. 10 shows a graph of a temperature of the non sheet-passing region, in the case where recording sheets of an A6T size (105 [mm]×148.5 [mm]) are passed through in an image forming apparatus that can fix recording sheets of up to an A3 size, and a horizontal axis of FIG. 10 represents a position (distance from the center of a sheet-passing region) in a direction perpendicular to a direction in which the recording sheets pass through, and a longitudinal axis of FIG. 10 represents a temperature of a fixing roller.

FIG. 8 shows a graph of a relationship among a thickness of a demagnetization coil, a demagnetization rate, and the number of the wires bundled and twisted together to be the litz wire, using CAE (Computer Aided Engineering) analysis. A line 801 represents a relationship between a thickness of each of first demagnetization coils and a demagnetization rate, and a line 802 represents a relationship between a thickness of a second demagnetization coil and a demagnetization rate. Note that the first demagnetization coils represent the demagnetization coils 215*a* and 215*c*, and the second demagnetization coil represents the demagnetization coil 215*b*. The demagnetization coil 215*b* is arranged so as to partly overlap the demagnetization coils 215*a* and 215*c*.

As a model of the CAE analysis, the excitation coil 207 that is made by winding a litz wire 10 turns is employed. The litz wire consists of 114 wires and a diameter of each of the wires is ø0.17. The number of each of the demagnetization coils is determined so that each demagnetization coil covers on entirety of the excitation coil 207. In addition, the demagnetization rate of the second demagnetization coil has been obtained by using the litz wires consisting of the same number of wires bundled and twisted together as the first demagnetization coils.

Since cost of the litz wires accounts for a substantial portion of material cost to manufacture the demagnetization coils, the material cost can be reduced if the same litz wires are used for the first demagnetization coils and the second demagnetization coil. Also, litz wire consisting of less wires bundled and twisted together is at a lower price. Accordingly, if such litz wires are used, cost of the demagnetization coils can be reduced.

In addition, a line 803 represents a relationship between a thickness of the demagnetization coils and the number of wires bundled and twisted together to be the litz wire constituting the demagnetization coils. For the line 801 and 802, refer to a left longitudinal axis, and for the line 803, refer to a right longitudinal axis.

Note that the demagnetization rate in FIG. 8 represents an index number calculated by the following expression using ΔT1 and ΔT2, the ΔT1 being a temperature rise from a room temperature to a fixing temperature of the fixing device when the demagnetization coils are not used, and the ΔT2 being a temperature rise from the room temperature to the fixing temperature when the demagnetization coils are used.

$$(\text{demagnetization rate})=(\Delta T1-\Delta T2)/\Delta T1$$

As FIG. 8 shows, since the fixing device pertaining to the conventional art uses the same litz wires for the excitation coil and the demagnetization coil, a thickness of the demagnetization coil is as thick as 2.8 mm, as shown inside a dashed line 810. Therefore, neither of the first demagnetization coils and the second demagnetization coil can achieve a sufficient demagnetization rate.

On the other hand, by reducing the number of wires bundled and twisted together to be the litz wires, the demagnetization coils can be thin. By doing this, it can be seen that the demagnetization rate of each of the first and second demagnetization coils can be improved. In particular, the demagnetization rate of the second demagnetization coil is greatly improved by a synergistic effect of first demagnetization coils that has been made thin.

Accordingly, as in the present embodiment, it is possible to improve the demagnetization rate by making each of the demagnetization coils thin by reducing the number of the wires bundled and twisted together to be the litz wire constituting each of the demagnetization coils to less than the number of wires bundled and twisted together to be the litz wire constituting the excitation coil. Therefore, even if the fixing speed is increased, it is possible to prevent overheating of the non sheet-passing region.

In addition, conventionally, when the demagnetization coils are overlapped with each other, especially the demagnetization rate of the second demagnetization coil becomes too low for practical use. In addition, since manufacturing cost of the demagnetization coils is high, it is impossible to increase the number of the demagnetization coils. As a result, in order to fix recording sheets of various sizes, only a magnetic flux having a width narrower than the width of the non sheet-passing region can be demagnetized according to a size of a fed recording sheet. Accordingly, in order to prevent overheating of the non sheet-passing region, it is impossible to improve the fixing speed.

In contrast, like the present embodiment, by making the demagnetization coils thin by reducing the number of the wires bundled and twisted together to be the litz wire, it is possible to reduce cost of the demagnetization coils and greatly improve the demagnetization rate of the second demagnetization coil at the same time. Accordingly, many demagnetization coils that support recording sheets of more various sizes can be used, and then a magnetic flux can be demagnetized in an appropriate range according to a size of recording sheets. Therefore, it is possible to prevent overheating of the non sheet-passing region.

[4] Modification

As described above, the present invention has been explained based on the embodiment, but it is obvious that the present invention is not limited to the above embodiment. The following modification can be expected.

In the above embodiment, the three pairs of the demagnetization coils 215*a*-215*c* each made by winding the litz wire 19 turns are employed. The litz wire consists of 20 wires bundled and twisted together and a diameter of each of the wires is ø0.17. However, it is obvious that the present invention is not limited to this. If each of the demagnetization coils is made of litz wire consisting of fewer wires bundled and twisted together than wires bundled and twisted together to be litz wire constituting the excitation coil and the demagnetization coils are made thinner than the excitation coil, the number of the wires bundled and twisted together to be the litz wire may not be 20. Also, the number of turns of litz wire constituting each demagnetization coil may vary according to the number of wires bundled and twisted together to be each litz wire, and only has to cover the excitation coil.

[5] Additional Remark

Note that, according to the present invention, the demagnetization coils provided close to the excitation coil have a thickness smaller than a thickness of the excitation coil in the axis direction of the coils, i.e., the radial direction of the heat generating rotational body, and accordingly it is possible to enhance magnetic coupling between the excitation coil and the demagnetization coils to improve demagnetization efficiency. It is therefore possible to prevent overheating in the non sheet-passing region even when the fixing speed for fixing the small-sized sheets is increased.

In this case, the excitation coil and the demagnetization coil may be each a wound litz wire, the litz wire constituting the demagnetization coil may have an outer diameter smaller than an outer diameter of the litz wire constituting the excitation coil, and a number of turns of the litz wire constituting the demagnetization coil may be greater than a number of turns of the litz wire constituting the excitation coil. In particular, if each of the litz wires constituting the excitation coil and the demagnetization coil is composed of wires bundled and twisted together and a number of the wires in the litz wire constituting the demagnetization coil is smaller than a number of the wires in the litz wire constituting the excitation coil so that the outer diameter of the litz wire constituting the demagnetization coil is smaller than the outer diameter of the litz wire constituting the excitation coil, the demagnetization coils can be thinner. Also, material costs of the demagnetization coils can be reduced and accordingly the fixing device can be provided at a low price.

Also, the demagnetization coil may have perpendicular portions and parallel portions, in a plan view, the perpendicular portions may be substantially perpendicular to a rotational axis direction of the heat generating rotational body, the parallel portions may be substantially parallel to the rotational axis direction, and a width of each of the perpendicular portions in the rotational axis direction may be smaller than a width of each of the parallel portions in a direction perpendicular to the rotational axis direction, and each of the perpendicular portions may have a thickness greater than a thickness of each of the parallel portions in the axis direction of the coils. Thus, it is possible to change a demagnetization rate at a boundary between a demagnetized area and outside thereof more rapidly, and accordingly overheating of the non sheet-passing region can be prevented more reliably.

Also, the demagnetization coil may be provided in a plurality, the plurality of demagnetization coils may be divided into two sets each including the same number of the demagnetization coils that are substantially lined up, the demagnetization coils included in one of the sets may positionally correspond to the demagnetization coils included in another set, and the two sets may cover respective end regions of the excitation coil in a rotational axis direction of the heat generating rotational body. Thus, it is possible to change a size of the demagnetized area according to sizes of recording sheets of various sizes. It is therefore possible to prevent overheating in the non sheet-passing region, which occurs when the demagnetized area has a smaller width than a width of the non sheet-passing region.

Also, in each of the two sets, one of the plurality of the demagnetization coils that is positioned closest to a center of the excitation coil in the rotational axis direction of the heat generating rotational body may be closest to the excitation coil in the axis direction of the coils. When postcards or recording sheets of a small size such as an A6T size are passed through, a temperature increase particularly in the non sheet-passing region is extreme and this has been prevented speeding up of the fixing speed. However, according to the present invention, it is possible to achieve sufficient demagnetization efficiency even in such a case and accordingly a temperature increase in the non sheet-passing region can be prevented.

Also, the demagnetization coils may be a plurality of layered printed boards that are flexible boards each having a coil printed thereon. This can also enhance magnetic coupling between the demagnetization coils and the excitation coil by reducing a thickness of each of the demagnetization coils, and accordingly demagnetization efficiency can be improved. Therefore, overheating in the non sheet-passing region can be prevented even when the fixing speed is increased.

The image forming apparatus pertaining to the present invention is characterized in including the fixing device pertaining to the present invention. This allows the image forming apparatus to achieve an effect of the fixing device pertaining to the present invention.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device that thermally fixes toner images on recording sheets of various sizes, the fixing device comprising:

a conductive heat generating rotational body configured to heat toner images;

an excitation coil positioned along a part of an outer circumferential surface of the heat generating rotational body and configured to generate a magnetic flux to heat the heat generating rotational body by electromagnetic induction; and a demagnetization coil positioned close to the excitation coil so as to cover a part of the excitation coil and configured to cancel, when a toner image is being fixed on a smaller-sized recording sheet, a part of the magnetic flux generated by the excitation coil so that overheating is prevented in a region where no recording sheet passes through of the heat generating rotational body, wherein the demagnetization coil has a thickness smaller than a thickness of the excitation coil in a radial direction of the heat generating rotational body;

wherein the excitation coil and the demagnetization coil are each a wound litz wire, the litz wire constituting the demagnetization coil has an outer diameter smaller than an outer diameter of the litz wire constituting the excitation coil, and a number of turns of the litz wire constituting the demagnetization coil is greater than a number of turns of the litz wire constituting the excitation coil.

2. The fixing device of claim 1, wherein each of the litz wires constituting the excitation coil and the demagnetization coil is composed of wires bundled and twisted together, a number of the wires in the litz wire constituting the demagnetization coil is smaller than a number of the wires in the litz wire constituting the excitation coil, so that the outer diameter of the litz wire constituting the demagnetization coil is smaller than the outer diameter of the litz wire constituting the excitation coil.

3. The fixing device of claim 1, wherein the demagnetization coil is provided in a plurality, the plurality of demagnetization coils are divided into two sets each including the same number of the demagnetization coils that are substantially lined up, the demagnetization coils included in one of the sets positionally correspond to the demagnetization coils included in another set, and the two sets cover respective end regions of the excitation coil in a rotational axis direction of the heat generating rotational body.

4. The fixing device of claim 3, wherein in each of the two sets, one of the plurality of the demagnetization coils that is positioned closest to a center of the excitation coil in the rotational axis direction of the heat generating rotational body is closest to the excitation coil in the radial direction of the heat generating rotational body.

5. An image forming apparatus including the fixing device of claim 1.

6. A fixing device that thermally fixes toner images on recording sheets of various sizes, the fixing device comprising:

a conductive heat generating rotational body configured to heat toner images;

an excitation coil positioned along a part of an outer circumferential surface of the heat generating rotational body and configured to generate a magnetic flux to heat the heat generating rotational body by electromagnetic induction; and a demagnetization coil positioned close to the excitation coil so as to cover a part of the excitation coil and configured to cancel, when a toner image is being fixed on a smaller-sized recording sheet, a part of the magnetic flux generated by the excitation coil so that overheating is prevented in a region where no recording sheet passes through of the heat generating rotational body, wherein the demagnetization coil has a thickness smaller than a thickness of the excitation coil in a radial direction of the heat generating rotational body;

wherein the demagnetization coil has perpendicular portions and parallel portions, in a plan view, the perpendicular portions are substantially perpendicular to a rotational axis direction of the heat generating rotational body, the parallel portions are substantially parallel to the rotational axis direction, and a width of each of the perpendicular portions in the rotational axis direction is smaller than a width of each of the parallel portions in a direction perpendicular to the rotational axis direction, and each of the perpendicular portions has a thickness greater than a thickness of each of the parallel portions in the radial direction of the heat generating rotational body.

7. An image forming apparatus including the fixing device of claim 6.

8. The fixing device of claim 6, wherein the demagnetization coil is provided in a plurality, the plurality of demagnetization coils are divided into two sets each including the same number of the demagnetization coils that are substantially lined up, the demagnetization coils included in one of the sets positionally correspond to the demagnetization coils included in another set, and the two sets cover respective end regions of the excitation coil in a rotational axis direction of the heat generating rotational body.

9. The fixing device of claim 8, wherein in each of the two sets, one of the plurality of the demagnetization coils that is positioned closest to a center of the excitation coil in the rotational axis direction of the heat generating rotational body is closest to the excitation coil in the radial direction of the heat generating rotational body.

* * * * *